US011457670B2

(12) United States Patent
Cleghorn et al.

(10) Patent No.: US 11,457,670 B2
(45) Date of Patent: Oct. 4, 2022

(54) TACTICAL SHIRTS

(71) Applicant: Kryptek Outdoor Group, LLC, Eagle, ID (US)

(72) Inventors: Josh Cleghorn, Eagle, ID (US); Greg Houser, Eagle, ID (US); Kevin Holland, Eagle, ID (US)

(73) Assignee: Kryptek Outdoor Group, LLC, Eagle, ID (US)

( * ) Notice: Subject to any disclaimer, the term of this patent is extended or adjusted under 35 U.S.C. 154(b) by 183 days.

(21) Appl. No.: 16/870,299

(22) Filed: May 8, 2020

(65) Prior Publication Data

US 2020/0359709 A1 Nov. 19, 2020

Related U.S. Application Data

(60) Provisional application No. 62/848,542, filed on May 15, 2019.

(51) Int. Cl.
*A41B 1/08* (2006.01)
*A41D 31/12* (2019.01)

(52) U.S. Cl.
CPC ..... *A41B 1/08* (2013.01); *A41D 31/125* (2019.02)

(58) Field of Classification Search
CPC ..... A41B 1/00; A41B 1/08; A41D 27/18
See application file for complete search history.

(56) References Cited

U.S. PATENT DOCUMENTS 2,707,786 A * 5/1955 Stoner ..... A41D 27/18 2/119
7,069,598 B1 * 7/2006 Welch ..... A41D 13/0051 2/129
2006/0048263 A1 * 3/2006 Walsh ..... A41D 31/12 2/69
2008/0060113 A1 * 3/2008 Walsh ..... A41D 27/10 2/116
2008/0289079 A1 * 11/2008 Lewis ..... G09B 23/281 2/114
2010/0199406 A1 * 8/2010 Dua ..... D06H 5/00 2/115
2010/0325773 A1 * 12/2010 Rock ..... A41D 1/04 2/113
2011/0289644 A1 * 12/2011 Beshlian ..... A41D 13/1209 2/46
2011/0314585 A1 * 12/2011 Blakely ..... A41D 13/08 2/69

(Continued)

*Primary Examiner* — Khaled Annis
(74) *Attorney, Agent, or Firm* — K&L Gates LLP

(57) ABSTRACT

Shirts are disclosed that may be worn by tactical operators. In an embodiment, the shirt includes a body to be disposed about a torso of a wearer, a body to be disposed about a torso of a wearer, and pair of sleeves to receive the wearer's arms. In addition, the shirt includes a collar assembly including a port including a V-shaped region, and a collar extending from the port. The collar has a first portion extending a first length from the port, and a second portion extending a second length from the port. The first length is longer than the second length, and the second portion extends from the V-shaped region of the port. The body and the collar assembly comprise a first material, the pair of shoulder and the pair of sleeves comprise a second material, and the second material is more abrasion resistant than the first material.

12 Claims, 3 Drawing Sheets

(56) References Cited

U.S. PATENT DOCUMENTS

| | | | | |
|---|---|---|---|---|
| 2012/0144542 | A1* | 6/2012 | Evans | A41D 13/08 2/16 |
| 2012/0210488 | A1* | 8/2012 | Blakely | A41D 13/0015 2/69 |
| 2012/0216327 | A1* | 8/2012 | Turner | A41D 13/0593 2/69 |
| 2012/0311760 | A1* | 12/2012 | Puni | A41B 1/08 2/69 |
| 2014/0317826 | A1* | 10/2014 | Decker | A41D 13/00 2/69 |
| 2015/0000003 | A1* | 1/2015 | Blakely | A41D 13/08 2/69 |
| 2016/0000152 | A1* | 1/2016 | Martin | A41B 9/06 2/113 |
| 2016/0270728 | A1* | 9/2016 | McGinnis | A61B 5/0205 |
| 2017/0035122 | A1* | 2/2017 | Farron | A41D 3/02 |
| 2018/0249775 | A1* | 9/2018 | Pitchforth | A41D 27/00 |
| 2019/0133216 | A1* | 5/2019 | Durham | A41D 27/28 |
| 2019/0335822 | A1* | 11/2019 | Jesch | A41D 27/28 |
| 2019/0380408 | A1* | 12/2019 | Tanzman | A41D 13/0015 |
| 2020/0268059 | A1* | 8/2020 | Kraikhajornkitti | A41D 13/0015 |
| 2020/0297038 | A1* | 9/2020 | Carlino | A41D 27/18 |

* cited by examiner

TACTICAL SHIRTS

CROSS-REFERENCE TO RELATED APPLICATIONS

This application claims priority to U.S. Provisional Patent Application No. 62/848,542 entitled TACTICAL SHIRTS filed on May 15, 2019, the entire contents of which are incorporated by reference herein and relied upon.

STATEMENT REGARDING FEDERALLY SPONSORED RESEARCH OR DEVELOPMENT

Not applicable.

BACKGROUND

Tactical operators (e.g., soldiers, police officers, security and emergency response personnel who possess specialized knowledge, skills and/or training) may encounter situations that are both dangerous and that call for high levels of physical exertion. In addition, such tactical operators (or more simply "operators") may be disposed in relatively warm climates and may carry heavy, heat-retaining equipment (e.g., body armor), which thereby increases the associated physical demands of the operator's tasks.

SUMMARY

In light of the disclosure herein, and without limiting the scope of the invention in any way, in a first aspect of the present disclosure, which may be combined with any other aspect listed herein unless specified otherwise, a shirt includes a body to be disposed about a torso of a wearer, a pair of shoulders to be disposed about the wearer's shoulders, a pair of sleeves to receive the wearer's arms, and a collar assembly. The collar assembly includes a port including a V-shaped region and a collar extending from the port. The collar has a first portion extending a first length from the port, and a second portion extending a second length from the port. The first length is longer than the second length. The second portion extends from the V-shaped region of the port. The body and the collar assembly comprise a first material. The pair of shoulder and the pair of sleeves comprise a second material. The second material is more abrasion resistant than the first material.

In a second aspect of the present disclosure, which may be combined with any other aspect listed herein unless specified otherwise, the second portion of the collar or the V-shaped region of the port is free of buttons, zippers, or other clasps.

In a third aspect of the present disclosure, which may be combined with any other aspect listed herein unless specified otherwise, the second material has a higher thermal insulation value than the first material.

In a fourth aspect of the present disclosure, which may be combined with any other aspect listed herein unless specified otherwise, the first material is configured to stretch more than the second material when an identical force is applied along a direction.

In a fifth aspect of the present disclosure, which may be combined with any other aspect listed herein unless specified otherwise, the first material is configured to wick moisture away from the wearer's skin.

In a sixth aspect of the present disclosure, which may be combined with any other aspect listed herein unless specified otherwise, the body is configured to be worn underneath body armor.

In a seventh aspect of the present disclosure, which may be combined with any other aspect listed herein unless specified otherwise, a shirt includes a body, a pair of shoulders, a pair of sleeves, and a collar assembly. The collar assembly includes a port including a V-shaped region and a collar extending from the port. The collar has a first portion extending a first length from the port, and a second portion extending a second length from the port. The first length is longer than the second length. The second portion extends from the V-shaped region of the port. The body and the collar assembly comprise a first material. The pair of shoulder and the pair of sleeves comprise a second material. The second portion of the collar and the V-shaped region of the port is free of buttons, zippers, or other clasps.

In an eighth aspect of the present disclosure, which may be combined with any other aspect listed herein unless specified otherwise, the second material is more abrasion resistant than the first material.

In a ninth aspect of the present disclosure, which may be combined with any other aspect listed herein unless specified otherwise, the second material has a higher thermal insulation value than the first material.

In a tenth aspect of the present disclosure, which may be combined with any other aspect listed herein unless specified otherwise, the first material is configured to stretch more than the second material when an identical force is applied along a direction.

In an eleventh aspect of the present disclosure, which may be combined with any other aspect listed herein unless specified otherwise, the first material is configured to wick moisture away from a wearer's skin.

In a twelfth aspect of the present disclosure, which may be combined with any other aspect listed herein unless specified otherwise, the body is configured to be worn underneath body armor.

Additional features and advantages of the disclosed devices, systems, and methods are described in, and will be apparent from, the following Detailed Description and the Figures. The features and advantages described herein are not all-inclusive and, in particular, many additional features and advantages will be apparent to one of ordinary skill in the art in view of the figures and description. Also, any particular embodiment does not have to have all of the advantages listed herein. Moreover, it should be noted that the language used in the specification has been selected for readability and instructional purposes, and not to limit the scope of the inventive subject matter.

BRIEF DESCRIPTION OF THE FIGURES

Understanding that figures depict only typical embodiments of the invention and are not to be considered to be limiting the scope of the present disclosure, the present disclosure is described and explained with additional specificity and detail through the use of the accompanying figures. The figures are listed below.

DETAILED DESCRIPTION

Figure 2:
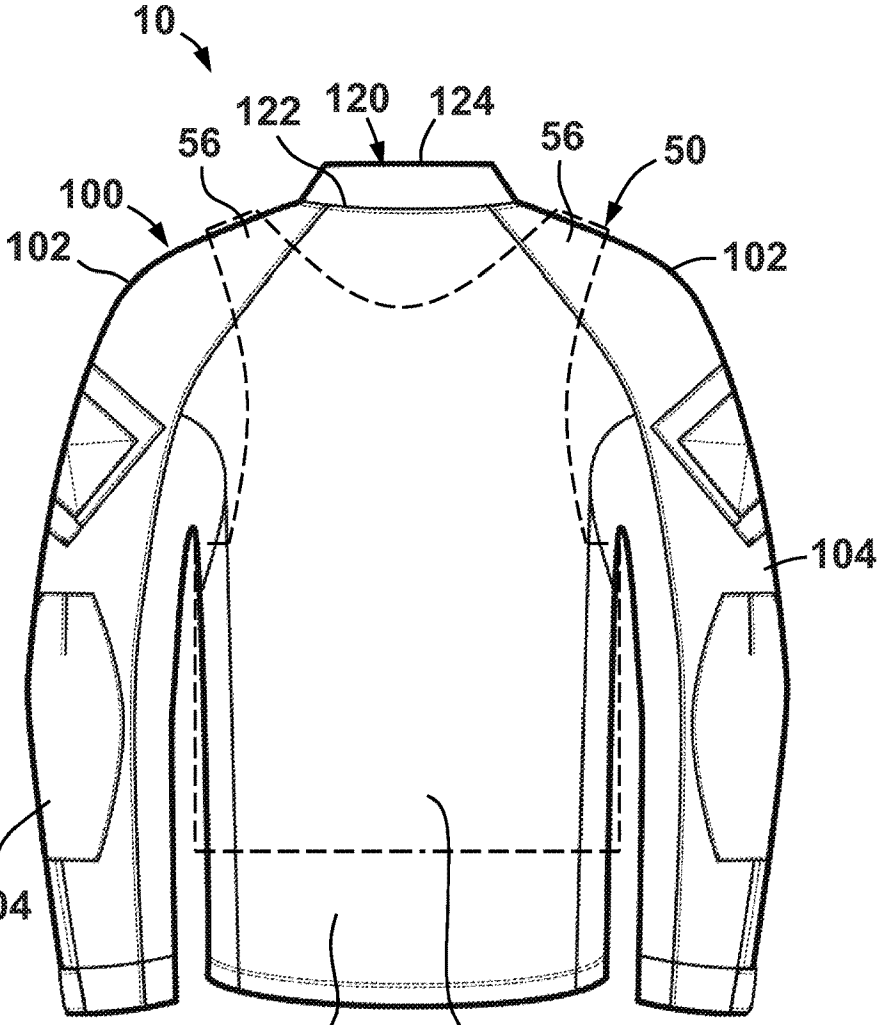
FIG. 2 is a rear view of the tactical shirt of FIG. 1.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. Further, when used herein (including in the claims), the words "about," "generally," "substantially," "approximately," and the like mean within a range of plus or minus 10%.

As previously described, operators may wear heavy, heat-retaining equipment in relatively warm climates. As a result, the operator's choice of clothing may help to avoid overheating, chaffing, and other negative impacts. For instance, chaffing and overheating from body armor may lead to injuries or worse for operators as they attempt to complete their assigned duties. Accordingly, embodiments disclosed herein include tactical shirts to be worn by operators underneath other equipment, such as body armor, in order to enhance heat transfer, moisture wicking, to reduce chaffing and otherwise increase overall comfort.

Figure 1:
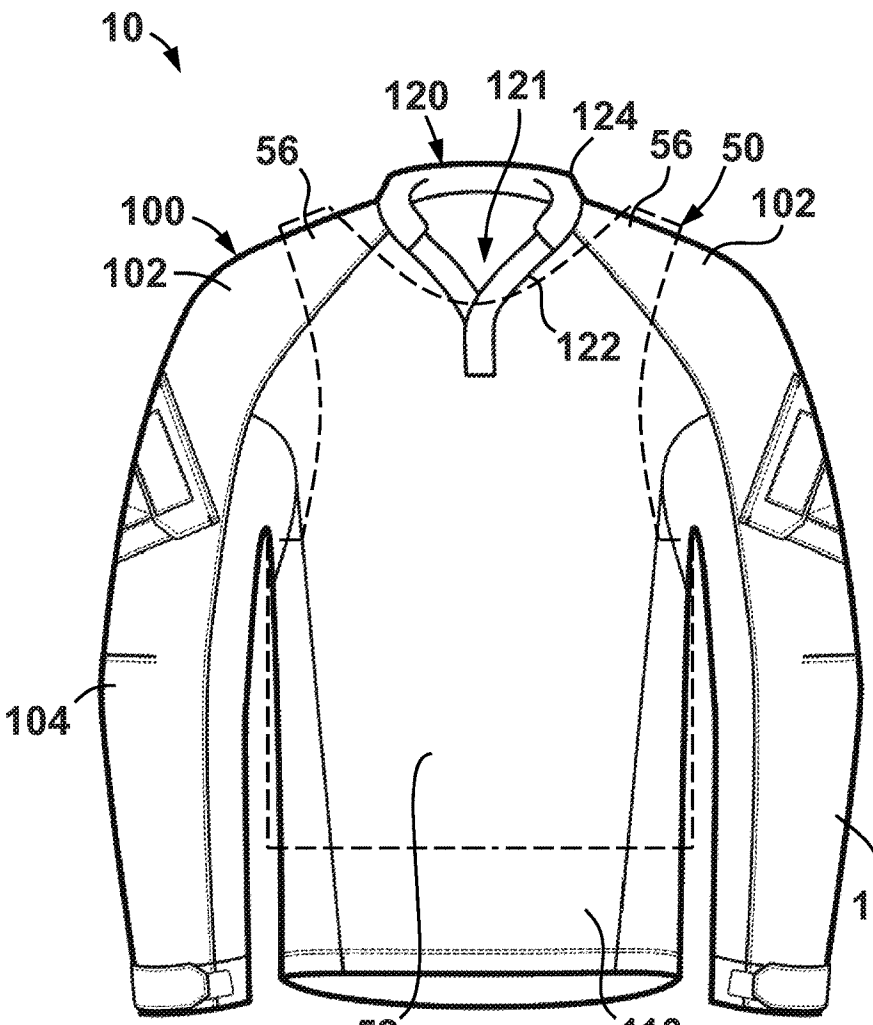
FIG. 1 is a front view of a tactical shirt according to some embodiments.

Referring now to FIGS. 1 and 2, a tactical shirt 100 according to some embodiments is shown. As will be described below, in some embodiments tactical shirt 100 may be worn underneath body armor. Thus, in FIGS. 1 and 2, a body armor vest 50 is shown in hidden line, so as not to occlude the features of shirt 100.

Shirt 100 includes a torso or body 110, a pair of shoulder portions 102 and a pair of sleeves 104. The body 110 is configured to be worn about the wearer's torso, the shoulder portions 102 are configured to be disposed about the wearer's shoulders, and the sleeves 104 are configured to receive the wearer's arms. As shown in FIGS. 1 and 2, in some embodiments, each shoulder portion 102 and corresponding sleeve 104 may comprise the same piece (or pieces) of fabric. In some embodiments (e.g., such as the embodiments of FIGS. 1 and 2), sleeves 104 are so-called "long sleeves" that extend down to (and potentially past) the wearer's wrists.

Figure 3:
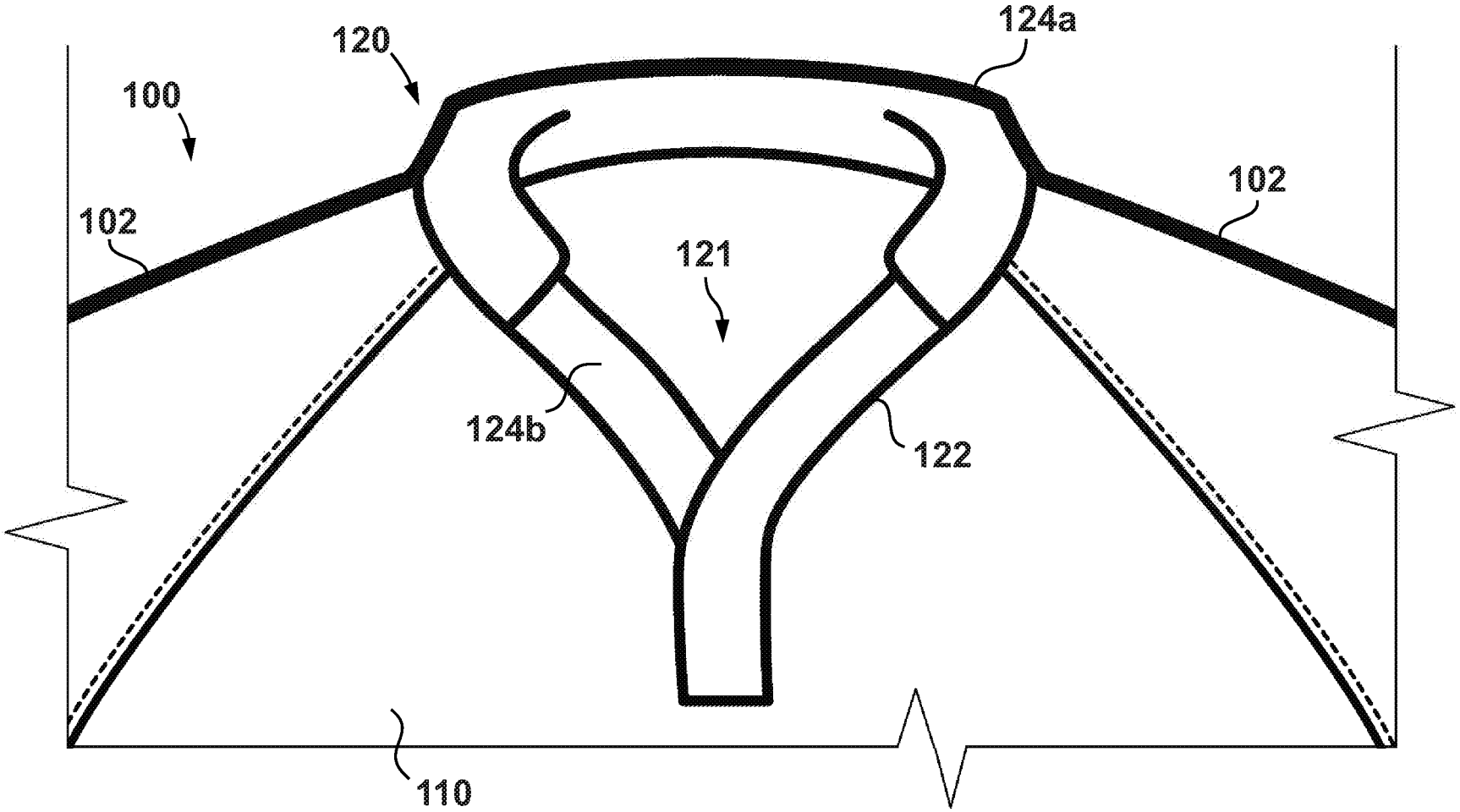
FIG. 3 is an enlarged front view of the collar assembly of the tactical shirt of FIG. 1.
Figure 4:
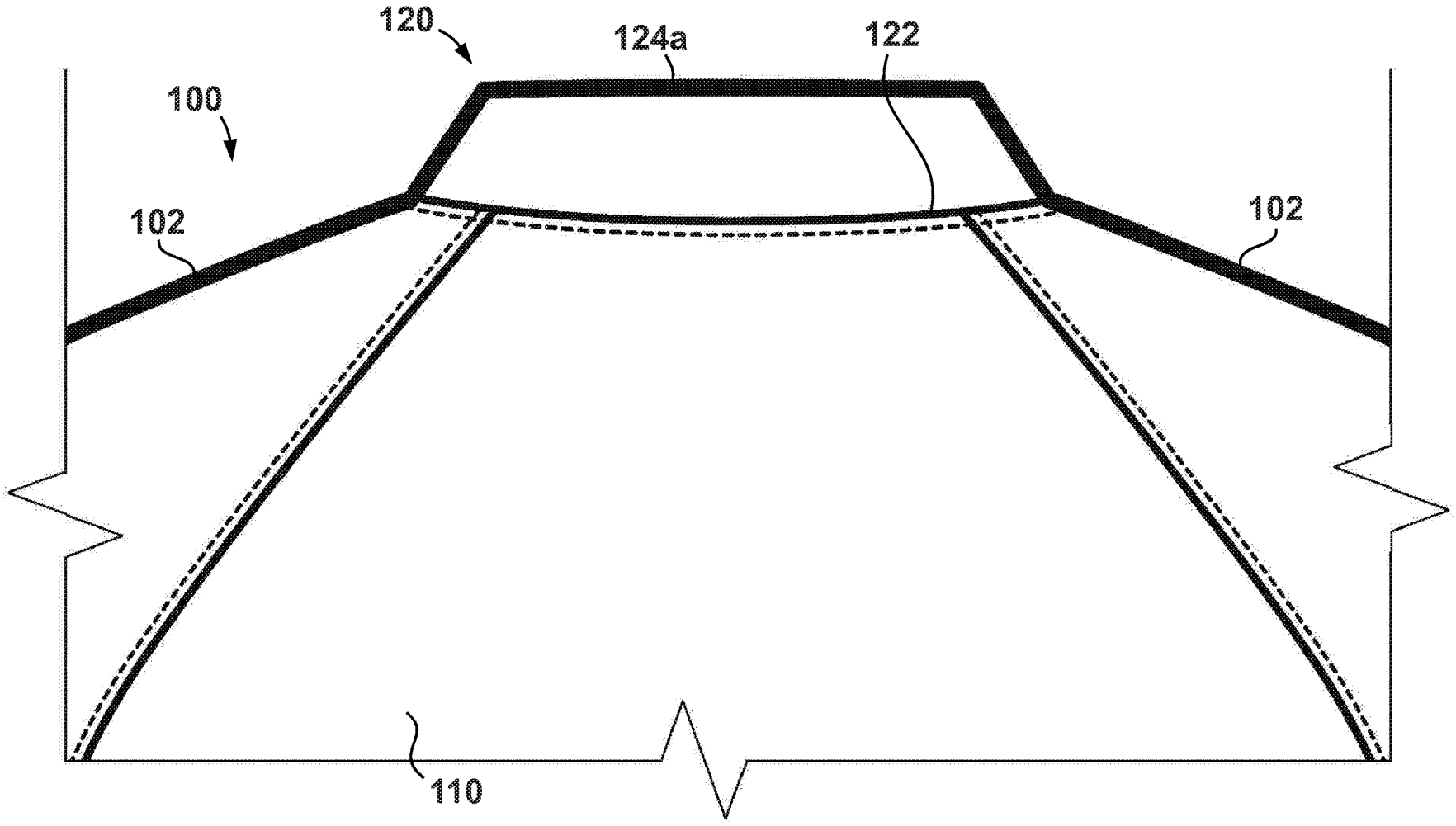
FIG. 4 is an enlarged rear view of the collar assembly of the tactical shirt of FIG. 1.

Referring now to FIGS. 3 and 4, shirt 100 also includes a collar assembly 120 including a hole or port 122 for a wearer's head to extend through and a collar 124 extending from port 122. In some embodiments, port 122 includes a V-neck profiled region 121 such that collar is ajar or spread at the wearer's neck. Without being limited to this or any other theory, the V-neck profiled region 121 of port 122 may allow air to easily flow or breathe into and out of port 122 at the wearer's neck and sternum, and thus more easily contact the wearer's skin so as to increase heat transfer (e.g., convective heat transfer) during operations.

Collar 124 extends from port 122 and includes a first portion 124*a* configured to surround the back and sides of the wearer's neck, and a second portion 124*b* lining a portion of port 122 that is to rest in front of the wearer's neck. As a result, the second portion 124*b* of collar 124 may be disposed along the V-neck profiled region 121 of port 122. First portion 124*a* of collar 124 extends a greater distance from port 122 than second portion 124*b* such that the portions of collar 124 adjacent the back and sides of the wearer's neck cover a greater amount of the wearer's skin in these regions or areas (e.g., along the sides and back of the wearer's neck). Without being limited to this or any other theory, the additional length of the material forming first portion 124*a* of collar 124 may help to reduce the risk of chaffing of the wearer's neck (e.g., by straps 56 or back side 54 of body armor vest 50 described in more detail below).

In some embodiments (such as the embodiments of FIGS. 1 and 2) no buttons, zippers, or other clasps are disposed along the V-neck profiled region 121 of the port 122 or second portion 124*b* of collar 124. Rather, the V-neck profiled region 121 of the port 122 is free of any fastening features. As will be described in more detail below, the lack of any such buttons, zippers, clasps, etc. along these portions may increase comfort since such rigid features may be pressed into the wearer's skin by the relatively heavy body armor vest 50.

Referring again to FIGS. 1 and 2, body armor vest 50 may comprise any suitable body armor material (e.g., KEVLAR®, metal or ceramic plates, etc.) that is configured to prevent (or at least restrict) the penetration of projectiles (e.g., bullets, shrapnel, etc.) therethrough. Body armor vest 50 generally includes a first or front side 52 and a second or rear side 54 that are joined by a pair of straps 56. Straps 56 rest on a wearer's shoulders while front side 52 and rear side 54 cover (partially or totally) the wears front and back torso, respectively. When vest 50 is worn over shirt 100 as shown in FIGS. 1 and 2, the front and rear sides 52 and 54 cover (substantially) the body 110. In addition, the front side 52 of vest 50 also covers a portion of the port 122 of collar assembly 120. When vest 50 is disposed over shirt 100, the two components may form a body armor system or assembly 10 that is configured to be worn by an operator during a tactical operation.

Referring still to FIGS. 1 and 2, in some embodiments the body 110 and collar assembly 120 (including collar 124) of shirt 100 comprises a lightweight, breathable fabric that is configured to wick moisture away from the wearer's body. For example, the body 110 and/or collar assembly 120 may comprise polyester, polypropylene, wool, merino wool, micromodel, or bamboo. In other examples, the body 110 and/or collar assembly 120 may comprise modacrylic, spandex, elastane, or the like. In some embodiments, the body 110 and collar assembly 120 may comprise a knitted material for improved air-flow. Generally, each of body 110 and collar assembly 120 are lighter-weight fabrics, when compared to fabrics associated with the shoulder portions 102 and sleeves 104. For example, the shoulder portions 102 and sleeves 104 of shirt 100 may comprise an abrasion resistant fabric. In some embodiments, the shoulder portions 102 and sleeves 104 of shirt 100 may comprise nylon.

Specifically, the material comprising the shoulders 102 and sleeves 104 may be more durable and abrasion resistant than the material comprising the body 110 and collar assembly 120. In some embodiments, the durability or abrasion resistance of the materials of shirt 100 may be measured by the methods described in U.S. Pat. No. 7,636,948 (e.g., a Modified Wayzenbeek abrasion test or by ASTM D 4157 Standard Test Method for Abrasion Resistance of Textile Fabrics (Oscillatory Cylinder Method), etc.), the contents of which are incorporated herein by reference in their entirety. In addition, because the material forming the body 110 and collar assembly 120 may comprise a knitted material, the material may be more easily stretched than the material forming the shoulders 102 and sleeves 104 (i.e., the material forming body 110 and collar assembly 120 may stretch further than the material forming shoulders 102 and sleeves 104 when placed under an identical force in a given axis or direction). Further, the material forming the body 110 and collar assembly 120 may have a lower thermal insulation than the materials forming shoulders 102 and sleeves 104. For instance, the material forming the body 110 and collar assembly 120 may have a lower do value than the material forming the shoulders 102 and sleeves 104 (where 1 clo=0.155 $K*m^2*W^{-1}$). Accordingly, in some embodiments, the material forming the body 110 and collar assembly 120 may be lighter (or weigh less) for a given surface area than the material forming the shoulders 102 and sleeves 104.

Without being limited to this or any other theory, by utilizing a lighter, moisture wicking material for the portions of shirt 100 that are covered (partially or totally) by body armor vest 50 (i.e., body 110 and collar assembly 120), the wearer's comfort may be increased by enhancing heat transfer and by more effectively wicking away moisture (e.g., sweat). Also, by constructing collar assembly 120 from a lighter, moisture wicking material, sweat that is formed or drips around the wearer's neck (e.g., sweat emanating from the wearer's head) is readily absorbed and wicked away by collar 124 (e.g., particularly first portion 124*a* of collar 124). In addition, because port 122 of collar assembly 120 includes no buttons, zippers, clasps, etc., the overlay of the front side 52 of body armor vest 50 does not drive any of these rigid components into the wearer's skin. Rather, one of more layers of the moisture wicking material forming body 110 and collar assembly 120 are placed between the wearer's skin and body armor vest 50, thereby reducing chaffing, enhancing thermal heat transfer and moisture wicking, and therefore increasing comfort.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

As used in this specification, including the claims, the term "and/or" is a conjunction that is either inclusive or exclusive. Accordingly, the term "and/or" either signifies the presence of two or more things in a group or signifies that one selection may be made from a group of alternatives.

Without further elaboration, it is believed that one skilled in the art can use the preceding description to utilize the claimed inventions to their fullest extent. The examples and embodiments disclosed herein are to be construed as merely illustrative and not a limitation of the scope of the present disclosure in any way. It will be apparent to those having skill in the art that changes may be made to the details of the above-described embodiments without departing from the underlying principles discussed. In other words, various modifications and improvements of the embodiments specifically disclosed in the description above are within the scope of the appended claims. For example, any suitable combination of features of the various embodiments described is contemplated. Note that elements recited in means-plus-function format are intended to be construed in accordance with 35 U.S.C. § 112 ¶6. The scope of the invention is therefore defined by the following claims.

The invention is claimed as follows:

1. A shirt, comprising:
a body to be disposed about a torso of a wearer;
a pair of shoulders to be disposed about the wearer's shoulders;
a pair of sleeves to receive the wearer's arms; and
a collar assembly comprising:
a port including a V-shaped region; and
a collar extending from the port, wherein the collar has a first portion extending a first length from the port, and a second portion extending a second length from the port, wherein the first length is longer than the second length, wherein the second portion extends from the V-shaped region of the port; and
wherein the body and the collar assembly are made of a singular first material;
wherein the pair of shoulder and the pair of sleeves are made of a singular, same piece of second material; and
wherein the second material is more abrasion resistant than the first material.

2. The shirt of claim 1, wherein the second portion of the collar or the V-shaped region of the port is free of buttons, zippers, or other clasps.

3. The shirt of claim 1, wherein the second material has a higher thermal insulation value than the first material.

4. The shirt of claim 3, wherein the first material is configured to stretch more than the second material when an identical force is applied along a direction.

5. The shirt of claim 4, wherein the first material is configured to wick moisture away from the wearer's skin.

6. The shirt of claim 1, wherein the body is underneath body armor, and wherein the body and the collar assembly is lighter than the pair of shoulders and sleeves.

7. A shirt, comprising:
a body;
a pair of shoulders;
a pair of sleeves; and
a collar assembly comprising:
a port including a V-shaped region; and
a collar extending from the port, wherein the collar has a first portion extending a first length from the port, and a second portion extending a second length from the port, wherein the first length is longer than the second length, wherein the second portion extends from the V-shaped region of the port; and
wherein the body and the collar assembly are made of a singular first material,
wherein the pair of shoulder and the pair of sleeves are made of a singular, same piece of second material, and
wherein the second portion of the collar and the V-shaped region of the port is free of buttons, zippers, or other clasps.

8. The shirt of claim 7, wherein the second material is more abrasion resistant than the first material.

9. The shirt of claim 7, wherein the second material has a higher thermal insulation value than the first material.

10. The shirt of claim 9, wherein the first material is configured to stretch more than the second material when an identical force is applied along a direction.

11. The shirt of claim 7, wherein the first material is configured to wick moisture away from a wearer's skin.

12. The shirt of claim 7, wherein the body is underneath body armor, and wherein the body and the collar assembly is lighter than the pair of shoulders and sleeves.

* * * * *